United States Patent [19]

Henry et al.

[11] Patent Number: 4,477,398

[45] Date of Patent: Oct. 16, 1984

[54] YARN MONITORING PROCESS

[75] Inventors: James W. Henry; Stanley R. Scroggin, both of Kingsport, Tenn.

[73] Assignee: Eastman Kodak Company, Rochester, N.Y.

[21] Appl. No.: 395,156

[22] Filed: Jul. 6, 1982

[51] Int. Cl.[3] ..... B29C 17/02

[52] U.S. Cl. ..... 264/40.1; 28/241; 73/160; 264/40.7

[58] Field of Search ..... 264/40.1, 40.7, 290.5, 264/290.7; 28/241, 242; 73/160

[56] References Cited

U.S. PATENT DOCUMENTS 2,715,701 8/1955 Moose et al. ..... 264/40.7

3,896,669 7/1975 Stecker et al. ..... 73/160

*Primary Examiner*—James B. Lowe

*Attorney, Agent, or Firm*—John F. Stevens; Daniel B. Reece, III

[57] ABSTRACT

Disclosed is a method of moving a roll out of contact with a work-piece in response to its developing a slower speed than normal while being driven by frictional engagement with the work-piece which comprises (a) generating an electrical signal as the roll moves past a reference point during each revolution, (b) using the electrical signal to set a timer for a predetermined duration, (c) timing each revolution of the roll by measuring time lapse between signals, (d) comparing the time for each revolution with the timer of predetermined duration, and (e) actuating a mechanism to withdraw the roll from contact with the work piece if a revolution is longer in time than the predetermined duration.

7 Claims, 2 Drawing Figures

YARN MONITORING PROCESS

DESCRIPTION

1. Technical Field

The present invention relates to a method of monitoring an endless, continuously moving work piece for a selected function by an idler roll. More specifically, this invention relates to a method for moving the idler roll out of contact with the work piece in response to its developing a slower speed than the work piece to protect it from damage.

2. Background Art

Tension gauges for large scale fiber bundles have been made in the past using commercial units equipped with friction guides or small rollers. The friction guides tended to increase the tension in the fiber bundle, while the small rollers tended to easily roll wrap. With excessive tension or roll wrap conditions, forces developed which resulted in destruction of the tension gauge.

DISCLOSURE OF THE INVENTION

This invention is particularly useful in monitoring the tension in a work piece such as a high strength, large diameter fiber web or a similar product. Tension is determined by measuring the mechanical reaction force of the web against an idler roller pressed against the web. The roll is of large diameter to prevent the accumulation of stray fibers which tend to wrap around smaller rolls. Mechanical means are sometimes incorporated to cut off any such accumulation which might occur. A digital logic system is incorporated into the arrangement which monitors the rotation of the idler roll determining when the rotational speed decreases below an acceptable minimum. Such a decrease is interpreted as a signal that adverse reactions are occurring in the web and that the roller system should be removed from contact with the web in order to preclude damage to the roller or the web material. Because of the extremely low roll speed experienced, a technique has been discovered in which the period of rotation of the roll is compared with the period of a timer adjusted to the minimum speed acceptable. If the roller completes its rotation after the timer, the system is triggered to remove the roller from the web. If the roller beats the timer, the system is arranged to continue measuring tension. In addition to this system of protection, delays may be incorporated to prevent the roll from being applied to the web until sufficient time had expired to permit the tow band to come up to speed. The apparatus offers utility in any application where tension must be measured on a work piece where entanglement or other mishap could damage either the work piece or the measuring apparatus.

The process for manufacture of polyester staple fiber requires that the fibers be molecularly oriented by drawing the fibers at an elevated temperature. The elongation process is carried out continuously by passing the fiber bundle through a series of rollers designed to produce traction on the fiber bundle sufficient that the difference in speeds between rollers will produce an elongating tension on the fiber bundle. Breakage of single filaments occurs with some regularity and these single filaments tend to wrap around the tractor roller so that a wrap of fiber carries around its circumference. Such roll wraps are undesirable in that they alter the drawing process parameters adversely. To assure that the proper tension is maintained, it is desirable that a tension meter be continuously in place on the tow bundle, so that tension is maintained at a level consistent with production of a good product. Since the tension monitor uses rollers subject to roll wrap, its operation is compromised by the effect plus the endangering of the rollers by excessive roll wrap which can cause permanent damage to the rollers and the associated tension gauge. The objective of the invention described in this application is to provide protective systems for these tension monitor rolls which will detect roll wraps, machine shutdown, tow line breakage or interruption, or other slack tow conditions which could result in tangling of the tension monitor rolls so that the rolls are subject to damage.

The invention described is useful in the manufacture of any product consisting of a web of any nature which is subject to roll wrapping, excessive tension buildup, and which requires consistent and accurate tension measurement. The apparatus overcomes the tendency to roll wrap and incorporates means to alleviate a roll wrap condition by mechanical removal of a sizeable portion of the roll wrap. In the event that such mechanical removal was insufficient, additional and last resort protection for the mechanical portions of the system is provided by a control system which detects roll wrap conditions or slack or tow runout and takes action to promote withdrawal of the tension monitor rolls from the vicinity of the tow bundle so that entanglement of the monitor with the tow bundle cannot take place.

BEST MODE FOR CARRYING OUT THE INVENTION

Figure 1:
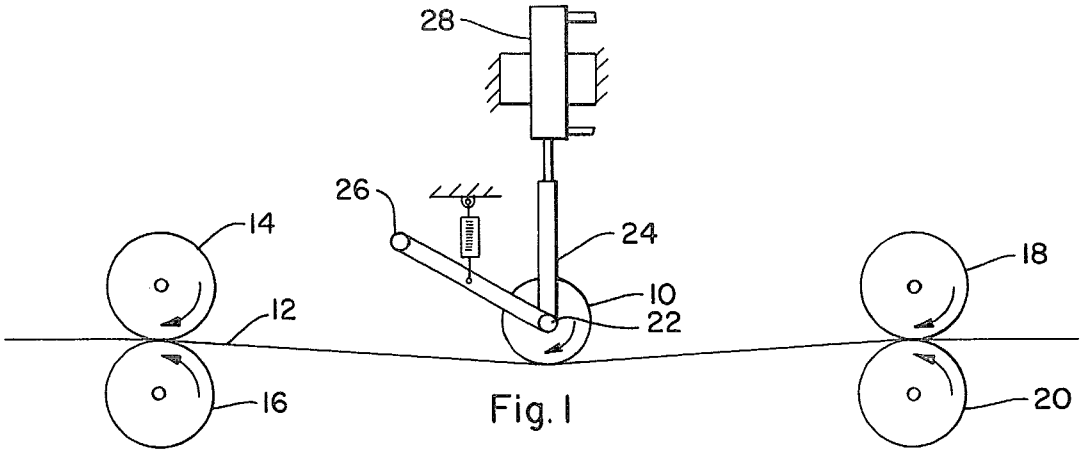
FIG. 1 is a diagrammatic elevation view illustrating the method according to this invention.

Referring to the drawings, idler roll 10 is normally in contact with work piece 12, which is drawn by feed rolls 14 and 16. Rolls 18 and 20 engage the work piece 12 in a manner similar to rolls 14 and 16 and in some instances, such as a fiber or web drawing operation, will rotate at a slower speed than feed rolls 14 and 16 so there is a stretching, or molecular orientation in the case of some polymeric material, in the space between the two sets of rolls. Roll 10 is in frictional engagement with work piece 12 and is thus driven thereby at a peripheral speed corresponding to the linear speed of work piece 12. Roll 10 is fixed on shaft 22 and rotates therewith. Roll 10 is rotatably mounted in arm 24 which is pivoted at fixed point 26. Pneumatic cylinder 28 serves to position and maintain roll 10 in contact with work piece 12 under normal operating conditions, but actuation of the pneumatic cylinder 28 withdraws roll 10 out of contact with the work piece 12. Shaft 22 is provided with a flat spot 30. Rotational period of the idler roll is measured by a magnetic reluctance pickup device consisting of a permanent magnet core 32 surrounded by a coil of magnet wire 34. The magnetic circuit is closed by the shaft carrying the idler roll. The single flat 30 is milled on this shaft. The magnetic reluctance of the flux path set up by the permanent magnet is altered by the periodic pressure of the flat on the shaft in the magnetic gap. When the full shaft is present, the flux is high. When the flat is present, the flux is abruptly reduced. Change in the flux magnitude results in induction of a current in the surrounding coil. The waveform of the voltage produced consists of two voltage spikes. The leading spike is positive in polarity and very short in duration. The trailing spike is negative and very short in duration. Only the leading spike is used. This voltage is supplied to the input of an operational amplifier which is biased to accept and amplify only the positive going pulse. Sufficient gain (about 300 ×) is incorporated in the amplifier to permit driving standard 5 volt logic elements. The amplified signal is fed into a conventional pulse shaper 40 which converts it into a square shape.

Setting the period of rotation for the idler roll 10 is effected by setting the period of a timer 42 associated with each roll. This timer 42 is digital in nature consisting of a conventional decade counter (not shown) supplied with 0.1 second pulses derived from counting down the 60 Hz power line frequency. Single pole, single throw switches select which of the array of 0–9 pulses accumulated by the counter will trigger the mechanism controlled by the roll rotation period and timer setting. Since it is unlikely that the first three stations of 0–2 will be required, only 7 switches are provided which permit selection of stations 3–9.

The output of pulse shaper 40 is fed into timer 42 and also into a conventional flip-flop 44. If a signal is produced by flip-flop 44, it is fed through relay 46, the output of which is used to actuate pneumatic cylinder 48 to withdraw idler roll 10 from contact with the work piece 12.

Figure 2:
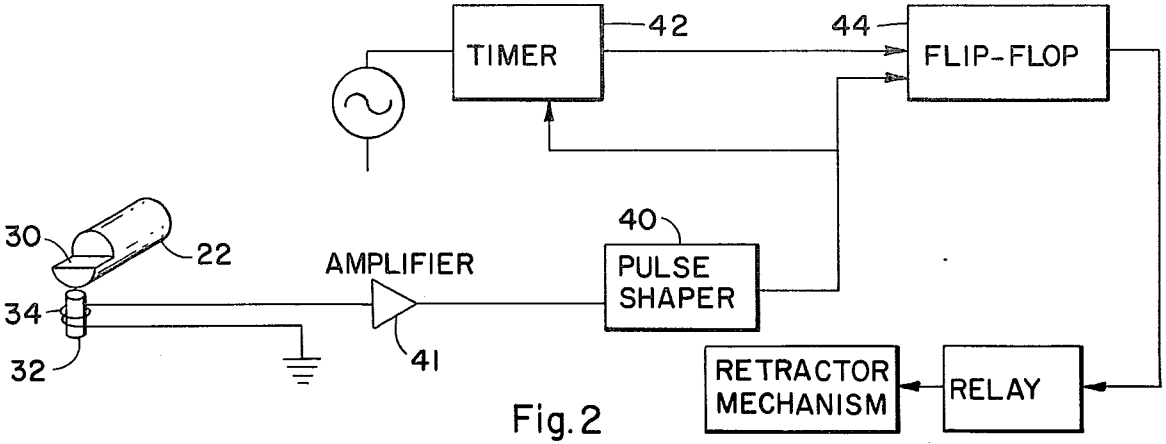
FIG. 2 is a diagram of the preferred circuitry for carrying out the method according to this invention.

Although the circuit components of FIG. 2 are conventional and well known in the art, a somewhat detailed description of a preferred embodiment follows.

The voltage produced at the magnetic reluctance pick-up is supplied from the amplifier 41 to the inputs (paralleled) of a 4 input NAND gate incorporating Schmidt trigger input circuitry to further shape the waveform of the pulse.

One gate is used for each roll period measurement system. This is designated as Type 7413. The shaped pulse is further modified prior to being used to control the Transistor-Transistor-Logic (TTL) logic system by passing it to a multivibrator system based on the TTL logic chip Type 74123. A constant width pulse of about 3 milliseconds duration is produced regardless of normal variation of the pulse produced by the reluctance pickup which varies its pulse width according to shaft speed.

Voltage spikes produced by the reluctance pickup are amplified by the RCA Type 3130 operational amplifier 41. The output signal of this amplifier is supplied to all 4 gate inputs of the Type 7413 Schmidt trigger gate 7413.1 in pins 1, 2, 4 and 5, with output at pin 6. The squared shaped signal is used to trigger a multivibrator 74123, and the 3 millisecond pulse duration produced is supplied to pin 13 going to logic zero and pin 11 going to a logic one. This derives pin 10 to logic one and pin 8 to logic zero.

The logic high produced at pin 11 of this flip-flop is supplied to pins 9 and 10 of 7400.2 NAND gate where it produces a logic low at pin 8 of 7400.2. Resetting of the flip flop by time out of the associated timer 7490.1 through the selected output of the 7 element switch associated with the counter (timer) and their 4 to 10 line decoders (7442) will produce a logic low at the reset flip-flop. If the flip-flop is reset (indicating that the timer has beat the roll rotation period), a logic high will result. The pulse produced by the roll period indicator pulse which triggers the flip-flop also resets the counter 7490.1 to zero by driving the counter control gate momentarily high and then setting it to the count (low) condition. This is accomplished by using NAND gates to accept trigger signals and transmit the appropriate high logic signal to the counter-timer 7490.1. A logic low pulse at either pins 1 and 2 of the gate will result in a momentary high pulse at pin 3 of the gate with resulting resetting of the associated counter timer.

The counter timer 7490.1 is supplied with 10 Hz pulses from counter 7482.1 which counts down by 6 the 60 Hz pulses delivered to it from 7413.2 which serves to shape a 60 Hz sine wave delivered from the 6.3 volt secondary voltage isolation transformer which serves as a clock frequency source. The 7492.2 counter also counts 60 Hz down by a factor of 2 to produce a 30 Hz pulse train to supply clock pulses to the timer composed of 7490.3, 7490.4, and 7490.5 which timer supplies a delay period prior to any attempt to set the idler rolls of the tension gauge back on the tow band.

Triggering of this flip-flop is a result of the timer which times the period of rotation of the idler roll of the tension monitor beating the period of rotation. Upon triggering due to this source, a logic low is developed on pin 8 of the 7400.4 gate which results in a logic high on pin 6 of 7400.5. This signal is inverted by 7404.1 and applied as a logic low to pin 13 of 7400.5 which results in pin 11 of 7400.5 going high so that the solid state relay driven by this pin is activated to activate a solenoid valve controlling an air cylinder retractor for the idler roll assembly. When pin 11 of 7400.5 goes high, it drives pin 8 of 7400.5 low deactivating the solid state relay driven from this pin. In this application, the gate 7400.5 pins 10, 9, and 8 are used as a simple logic signal invertor.

Pushbuttons are used to activate the retract and reset conditions of the idler roll. One button causes retraction and another pushbutton causes application. Upon pressing the reaction button, pin 13 of gate 7400.3 is driven low as is pin 9 of gate 7400.4. The function of gate 7400.4 has been described. Pins 13, 12, 11, 10, 9, and 8 of 7400.3 form a flip-flop used as a toggle to hold the electrical condition dictated by pressing either button. When pin 13 is low, the flip-flop is caused to assume a triggered condition with pin 11 high and pin 8 low. Pressing the retraction button drives pin 9 low with the result that pin 8 is high and pin 11 is driven low. With the pressing of either button, pins 1 or 2 of 7400.4 are driven low which drives pin 3 high. An invertor produces a low signal from this which is applied to flip-flop made from pins 1, 2, 3, 4, 5 and 6 of 7400.3. This low is applied to pin 1 of this combination triggering the flip flop and driving pin 6 low which activates the timer formed from counters 7490.3, 7490.4, and 7490.5. Time out of this timer produces a high signal at the input of 7404.1 pin 7 which produces a low applied to pin 5 of 7400.3 flip-flop thereby resetting it. The resetting operation produces a high at pin 12 of 7400.2 enabling this gate to pass any high applied to pin 13 of the gate. This enables the signal produced by the roll period timer beating the roll rotation period to pass through to activate the roll retraction device.

It will be observed that opening the gate to permit activation of the roll retraction device can occur only after the delay timer has timed out. Activation of the retraction push button produces immediate retraction of the rolls, but permits reapplication only after the timer has timed out. The timer will delay any manual effort to effect reapplication of the idler roll regardless of which button is pressed. Retraction of the roll is immediate, but the timer is activated and must be timed out before any reapplication of the roll can take place.

The invention has been described in detail with particular reference to preferred embodiments thereof, but it will be understood that variations and modifications can be effected within the spirit and scope of the invention.

We claim:

1. Method of moving a roll out of contact with a work-piece in response to its developing a slower speed than normal while being driven by frictional engagement with said moving work-piece which comprises (a) generating an electrical signal as said roll moves past a reference point during each revolution, (b) using said electrical signal to set a timer for a predetermined duration, (c) timing each revolution of the roll by measuring time lapse between signals, (d) comparing the time for each revolution with the timer of predetermined duration, and (e) actuating a mechanism to withdraw said roll from contact with the work piece if a revolution is longer in time than the predetermined duration.

2. Method according to claim 1 wherein the work-piece is a bundle of fibers.

3. Method according to claim 1 wherein the roll is part of a tension measuring device.

4. Method according to claim 1 wherein said electrical signal is generated at a magnetic reluctance pick-up adjacent said shaft.

5. Method according to claim 1 wherein said roll is rotably fixed to a shaft at its axis, and said shaft having means for creating a magnetic reluctance at said pick-up.

6. Method of moving a roll out of contact with a fiber bundle in response to its developing a slower speed than normal while being driven by frictional engagement with said fiber bundle which comprises (a) generating an electrical signal at a magnetic reluctance pick-up as said roll moves past a reference point during each revolution, (b) using said electrical signal to set a timer for a predetermined duration, (c) timing each revolution of the roll by measuring time lapse between signals, (d) comparing the time for each revolution with the timer of predetermined duration, and (e) actuating a mechanism to withdraw said roll from contact with the work piece if a revolution is longer in time than the predetermined duration.

7. Method according to claim 6 wherein said roll is rotatably fixed to a shaft at its axis, and said shaft having means for creating a magnetic reluctance at said pick-up.

* * * * *